US007100699B2

(12) United States Patent
Helms et al.

(10) Patent No.: US 7,100,699 B2
(45) Date of Patent: Sep. 5, 2006

(54) HIGH TENSILE LOADING TOP ENTRY SUB AND METHOD

(75) Inventors: Charles M. Helms, Danbury, TX (US); Vernon E. Kauffman, Friendswood, TX (US); Billy D. Jones, Friendswood, TX (US)

(73) Assignee: Specialty Rental Tools & Supply, LP, Alvin, TX (US)

( * ) Notice: Subject to any disclaimer, the term of this patent is extended or adjusted under 35 U.S.C. 154(b) by 286 days.

(21) Appl. No.: 10/468,501

(22) PCT Filed: Feb. 19, 2002

(86) PCT No.: PCT/US02/04518

§ 371 (c)(1),
(2), (4) Date: Apr. 14, 2004

(87) PCT Pub. No.: WO02/066792

PCT Pub. Date: Aug. 29, 2002

(65) Prior Publication Data

US 2004/0177973 A1 Sep. 16, 2004

Related U.S. Application Data

(60) Provisional application No. 60/269,395, filed on Feb. 16, 2001.

(51) Int. Cl.
*E21B 47/00* (2006.01)

(52) U.S. Cl. ..... 166/381; 166/77.1

(58) Field of Classification Search ..... 166/385, 166/117.5, 77.1, 85.5, 88.1, 88.4, 93.1, 97.5
See application file for complete search history.

(56) References Cited

U.S. PATENT DOCUMENTS

| | | | | |
|---|---|---|---|---|
| 4,685,516 | A * | 8/1987 | Smith et al. | 166/65.1 |
| 4,886,115 | A * | 12/1989 | Leggett et al. | 166/77.1 |
| RE33,150 | E | 1/1990 | Boyd | 166/242.5 |
| 5,284,210 | A | 2/1994 | Helms | 166/385 |
| 6,202,764 | B1 * | 3/2001 | Ables et al. | 175/162 |
| 6,269,879 | B1 | 8/2001 | Boyd | 166/242.5 |

* cited by examiner

*Primary Examiner*—Frank Tsay
(74) *Attorney, Agent, or Firm*—David B. Dickinson; Lundeen & Dickinson, LLP

(57) ABSTRACT

This invention relates to an elongated wireline entry device (10) which allows a wireline tool or coiled tubing with a tool attached to be inserted in a well bore without disconnection form the drill string appended thereto without introducing bending moments into the threaded connections (101, 106, 202) attached to the drill string because the pin and box connections of the tool are in axial, longitudinal alignment, the absence of these bending moments is required to suspend long pendular, and therefore heavy, drill strings for this device without failure. The angle between the longitudinal ayes of the longitudinal passage and the wireline passage in the wireline entry device is at most 4.0°.

21 Claims, 4 Drawing Sheets

HIGH TENSILE LOADING TOP ENTRY SUB AND METHOD

RELATED APPLICATION

The present application claims priority from U.S. Provisional Application 60/269,395 filed Feb. 16, 2001, which is hereby incorporated by reference.

BACKGROUND OF INVENTION

1. Field of the Invention

The present invention relates to an improved top entry sub for use in drilling operations; specifically, to an apparatus of rated high tensile strength permitting the introduction of wireline or coiled tubing into the annulus of either a long and heavy string of drill pipe or of a drill string which can experience significant tensile loading from the movement of a drilling platform, such as by wave action, without disconnecting the sub from the drill string connected.

2. Background

Prior art devices include the U.S. Pat. No. Re. 33,150 to Boyd that discloses a side-entry sub that permits the connection within a drill string maintaining the drill string member above the tool to remain in axial alignment with the drill string member below the tool. This side entry sub has a longitudinal passage and a wireline passage, wherein the longitudinal axes of each intersect at an angle of about 6.5°. This device, while permitting significant tensile loading, does not permit the introduction of wireline tools into the annulus without disconnecting the drill string below the sub after the insertion of the wireline. A connection to the tubular string below this Boyd device must be disconnected and the wireline threaded through the side entry and thereafter connected to the longer wireline tools that make up the normal wireline assembly.

Other prior art devices include U.S. Pat. No. 5,284,210 to Helms that discloses a top-entry sub permitting the introduction of wireline Into the annulus of a drill string without the need to disconnect the sub from the well string. In the embodiment disclosed in FIGS. 1 and 4, the longitudinal axis of the drill pipe above and below the top-entry sub are substantially aligned. The Helms patent also discloses a wear sleeve for use with a double pin sub connected to the bottom of the top entry sub to avoid wear in the double pin sub by the wireline. The sleeve can be rotated periodically so the wear is more evenly distributed to increase the useful life of the sleeve.

Boyd also has an elongated wireline entry sub referred to as the Long Boy. This tool has a main passage portion extending from the lower end of the tool body to an upper point of the tool body. This main passage then extends into a principal passage that would be threaded onto a pipe or upper sub member so as to support the tool as it is positioned within the drill string above the rig floor. There is formed a second passage wherein a wireline extends therethrough downward into the main passage of the tool. The longitudinal axes of these three passages form a somewhat Y-shape. The angle between the axes of the main passage and the principal passage is about 2°. The angle between the axes of the main passage and the wireline passage is about 2.25°. Therefore, the total angle between the axes of the principal and wireline passages is about 4.25°.

U.S. Pat. No. 6,269,879 to Boyd discloses a wireline entry sub, like the Boyd Long Boy, but also having a wear resistant sleeve (Rockwell hardness of around 50) in the bottom end of the sub and/or in a sub saver attached to the bottom thereof. When worn by the wireline, the sleeve in the bottom of the wireline entry sub can be rotated by removing a screw so that fresh unworn surface can be used. The axes of the main passage (referred to therein as the principal passage), the principal passage (referred to therein as the first principal passage) and the wireline passage (referred to therein as the second passage) also form a Y-shape.

The embodiment disclosed in FIG. 3 of the Helms patent, the Boyd Long Boy, and the elongated wireline entry sub disclosed in U.S. Pat. No. 6,269,879, however, introduce a bending moment into the drill string because of the offset between the longitudinal axis of the drill string above the wireline entry sub with the longitudinal axis of the drill string below the sub. As more and more tension is placed on such tools as from the use of long strings of drill pipe on offshore floating platforms, which can drill in up to 10,000 feet of water, the alignment of the upper drill string member with the lower drill string members becomes critical. The bending moment can overstress the threads on the string and cause failure of the system.

Thus, there is a need to improve and provide such a wireline device that minimizes the bending moment of prior art devices, provides axial alignment of the wireline or coiled tubing pathway over the drill pipe annulus, and provides the entry of wireline or coiled tubing devices without having to disconnect the drill string therefrom.

BRIEF SUMMARY OF THE INVENTION

The apparatus of the present invention has an annular tubular member constructed of pipe strength steel permitting extraordinary tension loading of a tool and also permitting the introduction of a flexible member with wireline or coil tubing tools attached thereto into the annulus under pressure and without having to disconnect below the tubular member to connect wireline or coil tubing tools to the introduced flexible member.

An apparatus according to the present invention has at least an elongate tubular member having two ports at the upper end portion of the tool and one port at the bottom end portion of the tool. One of the two ports on the upper end portion and the port at the bottom end portion are connected by a longitudinal bore or passage, wherein the longitudinal axis thereof is co-axial with that of the drill string above and below the tool. This avoids or minimizes the introduction of a bending moment into the drill string due to the presence of the apparatus according to the present invention.

In a preferred embodiment, the apparatus also has a wireline passage, wherein the longitudinal axes of the longitudinal passage and the wireline passage intersect at an angle of at most 4.0°, preferably at most 3.5°, and more preferably at most 3.0°.

In one embodiment of the invention, the apparatus of the present invention is further comprised of a saver sub which carries on its inner annular surface an insert ring or bushing between it and the upper tubular member which holds the wireline or coil tubing off of the connecting surfaces of the upper tubular member and the saver sub.

In another embodiment or in conjunction with the foregoing embodiment, the invention also contemplates that a wear bushing or ring can be also positioned in a recess adjacent the wireline or coiled tubing entry port of the wireline passage.

The present invention allows the line wear insert ring or bushing in either or both locations to be periodically rotated as wear develops from the abrasion of the wireline or coil tubing rubbing across it. The line wear insert ring or bushing can be formed from any hardened material that resists the abrasion of the wireline or coil tubing. Such hardened materials preferably having a Rockwell rating of 60 or harder. Suitable examples of such hardened materials include tungsten carbide, ceramics, and various hardened steels. In one embodiment, the inner wear ring or bushing is a generally circular member having a key slot formed in it. In an alternate embodiment, the inner wear ring is formed with a polygonal, for example, hexagonal, profile to seat in either a lower saver sub profile or a recess adjacent the wireline or coiled tubing entry port of the wireline passage. Whether the use of the key/keyseat or the polygonal form is adopted, the wear ring is seated and its rotation prevented as the tool is in use.

The overall length of the tool permits the introduction of wireline tools through the wireline or coil tubing entry portal, which is generally provided with a Bowen fitting. In the embodiments shown, the Bowen fitting includes a 10,000 psi collar or union that is seated with a 4 inch Acme stub, on an O-ring assembly to seal the wireline entry device. All other seats are typically metal to metal in accordance with standard drill string specifications and are capable of supporting heavy weight pipe up to 2 million pounds.

The apparatus of the present invention is particularly useful in deep water drilling operations from either a drilling platform or a drill ship where the heaving of seas causes the rise and fall of the drilling rig floor relative to the drill string. Such drilling operations can be performed in waters as deep as 10,000 feet deep. The suspension of 10,000 feet of drill pipe from the rig floor in a heavy sea causes tremendous tensile loading of the drill string and the apparatus of the present invention is intended to permit the apparatus to be used and connected within the drill string.

Since there are no offsets between the annulus of the drill string and the longitudinal axis of the longitudinal passage or bore therethrough, no bending moments are introduced into the pin or box connections at either end of the apparatus.

It is therefore an object of the present invention to provide a high tensile load wireline or coiled tubing entry device for use in deep water.

It is a further object of the present invention to provide a wireline or coiled tubing entry device which permits wireline tools connected to a wireline or coil tubing to be introduced into the annulus of the drill string without disconnection of the lower connection of the wireline entry apparatus from the drill string so that the full weight of the drill string can be supported by the elevators throughout the operation and thereby permitting the introduction of wireline tools under pressure through the tool.

A still further object of the invention to minimize the damage to the wireline entry apparatus when used with a wireline from the abrasion that a wireline or coiled tubing can cause to the threaded ends of the apparatus by providing a means of having a line wear insert ring or bushing at one or both ends of the apparatus which holds the wireline or coiled tubing off of the surface of the end of the tool, thereby preventing cutting of the tool inner surface from the abrasive movement of the wireline or tubing.

DETAILED DESCRIPTION OF THE PREFERRED EMBODIMENTS

Figure 1:
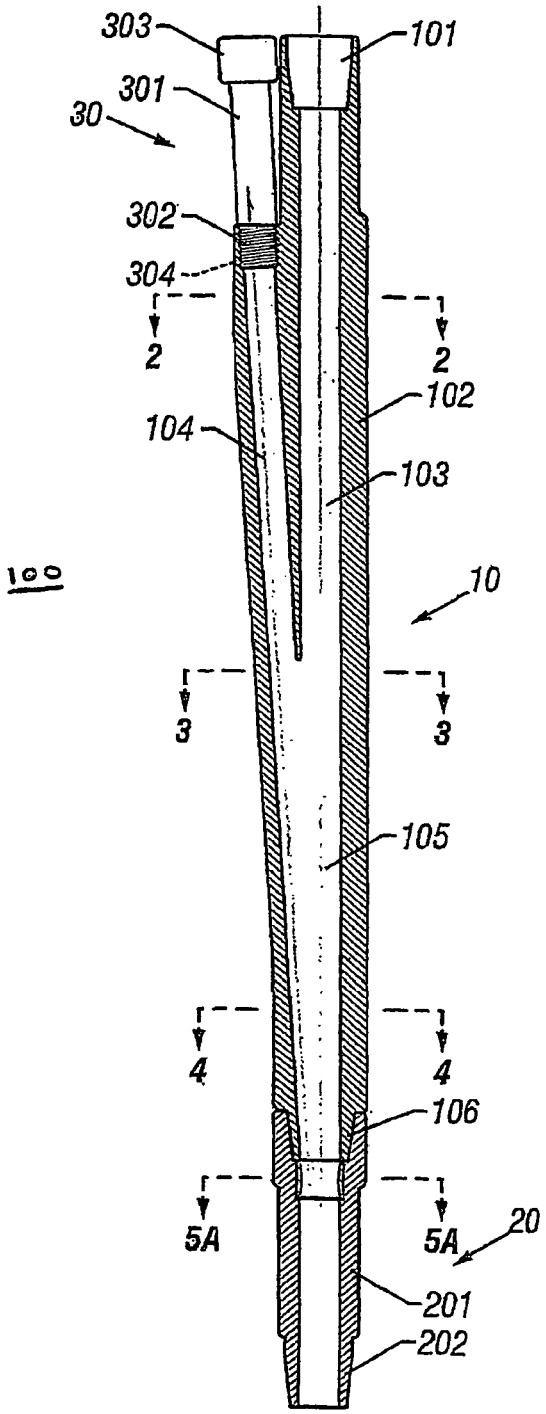
FIG. 1 is a cross sectional elevation view of an embodiment of the tool of this invention.
Figure 2:
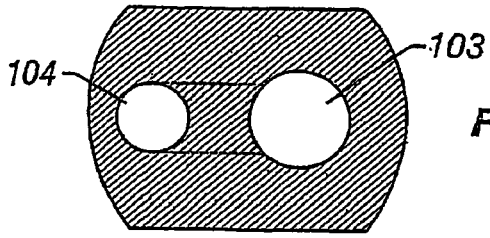
FIG. 2 is a cross sectional plan view through line to 2—2.

Referring now to the Figures where like numerals indicate similar elements, and in particular FIG. 1, there is shown an embodiment of a wireline entry sub 100 according to the present invention. Wireline entry sub 100 has a long upper annular tubular member generally referred to as 10 and a saver sub assembly shown at 20. The tubular member 10 is provided with threaded box connection 101 to provide connection to the tubular members forming the upper portion of the drill string in the embodiment shown. These threads can be API 6⅝ full hole threads, but other thread types can be substituted therefor without departing from the spirit of the disclosure made herein. The tool 100 in a preferred embodiment provides a 4.375 inch diameter entry into the top of the body 10 for fluid entry, which allows full circulation through the tool 100. Adjacent the top box end 101 of the tool 100 has a wireline entry side, which can be used to introduce either wireline or coiled tubing into the annular space formed within the main body of the tool 100. This is generally referred to as a Bowen-type fitting 30 which has a Bowen union or nut (collar) which has a standard 10K fitting 4¾ inch on its upper end and has a 4 inch Acme threaded stub on its lower end as well as an O-ring (not shown) to seal the wireline entry union in a manner well known to those in the field. The inner diameter in the preferred embodiment shown on the wireline entry side is 3 inches on its inner diameter. This design permits the introduction of wireline tools sizes up to, and including, 2⅞ inches by approximately 25-foot long tools or assemblies. As shown in FIG. 2, showing a cross sectional of the tool through the line 2—2 of FIG. 1, discloses there is no communication between the wireline entry device and the fluid entry passage at the upper end of the tool 100. The annular space 104 formed in the upper body 10 to permit entry of the wireline devices, extends into the body and joins the annular space 103 formed in the body at 102 at the main course of the body 105 as more clearly shown in FIG. 3, a cross sectional plan view of the upper tubular sub 10 through the line 3—3 of FIG. 1.

Figure 5A:
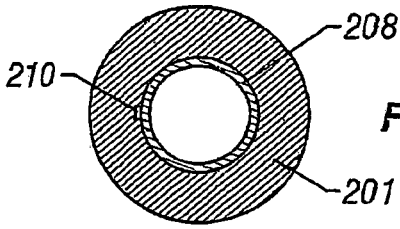
FIG. 5*a* is a cross sectional plan view through the line 5A—5A.
Figure 6:
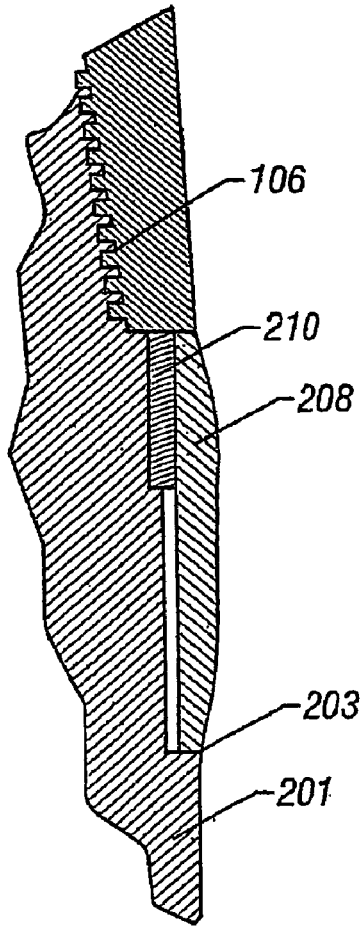
FIG. 6 is a cross-sectional view of the inner diameter of the tool showing the details of the wear bushing, key, lower sub and upper sub.

Upper body 10, preferably formed from a 4340 steel tubular blank, is also provided with threaded connections 106 in the form of a pin which, in the embodiment shown, are 7⅝ regular API thread. Saver sub 20 is preferably formed by machining 4340 steel tubular blank having thickened walls 201 providing an annular space therethrough. Referring to FIGS. 1, 5A and 6, saver sub 20 has a counter bore which forms a shoulder 203 and a hardened insert or wear bushing 208, preferably formed from D2 tool steel to resist cutting, that is inserted in the lower sub 20. Bushing 208 is held in place by key 210, which prevents rotation of the hardened wear bushing 208 and the bottom edge of pin 106. The wear bushing 208 provides longitudinal key grooves throughout the exterior of its body to fit key 210 to prevent rotation of the wear bushing 208 in operation. After significant wear appears on the wear bushing, the lower sub 20 can be removed and the wear bushing 208 rotated. Additionally, the wear bushing 208 can be turned over (that is, up side down) and reinserted into the lower sub 20 for further service. The wear pattern on the bushing 208 caused by its continued contact with the wireline is thereby evenly distributed over the entire inner periphery of the wear bushing.

Wear bushing 208 preferably has a plurality of grooves on its exterior surface, and thereby be capable of being rotated as needed to provide through each of the positions of wear corresponding to one of the grooves, for example, if there are 12 grooves, then there would be 12 positions of wear. Since wear is generally only on the upper portion of the bushing, the bushing can be flipped to provide, for example, 12 more wear positions, thereby providing as many as 24 wear positions.

Figure 5B:
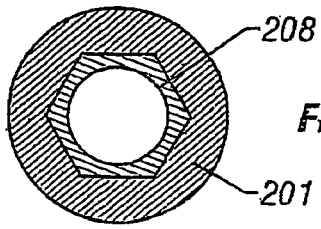
FIG. 5*b* is an alternative embodiment cross-sectional plan view of the tool through a line of equivalent location as the line 5A—5A of FIG. 5.

Alternatively, as shown in FIG. 5B, the wear bushing 208 could be formed in a polygonal shape, for example, a hexagonal shape, and rotated as wear developed in each face. It can be readily appreciated that a variety of geometric shapes or methods can be used to prevent rotation of the wear ring or bushing in the body without departing from the spirit of the invention disclosed herein.

FIG. 6 more clearly shows the relationship between the lower edge or shoulder formed on threaded pin 106 holding the hardened wear ring or bushing 208 against lower shoulder 203, which is the counter bore shoulder in the saver sub body 201. Pin 210 is inserted before completing connection or makeup of the upper body 102 with the saver sub 201 and locks the wear bushing in place. Pin 210 can be readily removed after threaded connection 106 is disconnected. In one embodiment, the overall length of the tool 10 is approximately 13 feet and the angle between the longitudinal axes of the longitudinal passage and the wireline passage is approximately 3 degrees. This angle of separation permits the Bowen collar or union to be at the appropriate height, yet provide clearance with the upper end of the tool 100.

The angle of separation also permits the introduction of wireline entry tools of up to 25 feet in length into the annular drill string with sufficient clearance to minimize rubbing or abrasion on the interior surfaces of the tool 100 or the exterior surfaces of the wireline tools or entry devices. Since the upper pin 101 is in axial alignment with the lower pin 202, there are no bending moments introduced that have marked prior art devices, such as that shown in FIG. 3 of U.S. Pat. No. 5,284,210, the Boyd Long Boy, and the elongated wireline entry sub disclosed in U.S. Pat. No. 6,269,879. Accordingly, much higher tensile loads can be imposed on the threaded connections without overstressing these links. The tool 100 will hold as much tensile load as the tubular members above and below it near the surface or drilling rig floor. As previously indicated, the present tool is particularly suitable for use in very deep offshore wells in which up to 10,000 feet of pipe can be suspended below the drilling rig platform in water before it enters the seabed. These tremendous tensile loads have imposed new and previously unexperienced design needs on wireline tool operators and those who supply equipment to wireline tool companies.

Other connections can be made as needed above and below the top entry sub, but the strength of the tool and the length of the tool suggest that it can be used for all known deep-water high tensile loading applications currently pending in the world and will perform as well as the drill pipe designed for these deep water applications perform.

Figure 7:
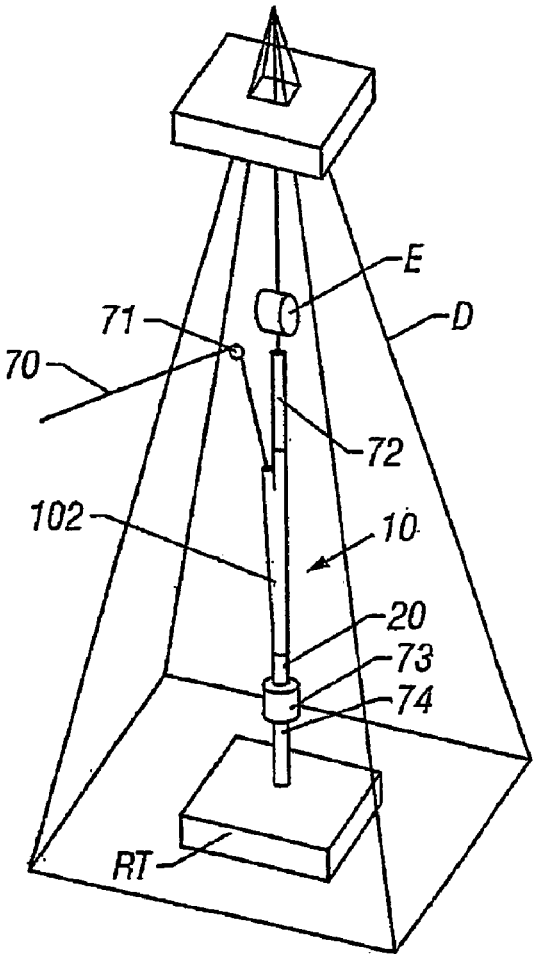
FIG. 7 is a schematic drawing of the tool of the present invention rigged to the drill string above a rig floor.

In such operations, the wireline contractor or pipe recovery contractor can connect the assembled tool onto the drill pipe by connecting the upper box 101 to the drill string tubular members shown symbolically in FIG. 7 as 72, descending from the elevators E in the derrick or rig D. This tool would also work with a top-drive rig setup in place of the conventional elevator rig set up shown. The saver sub 20 would be connected to an inline swivel 73 to which is connected a TIW valve 74. Thereafter, the operator would connect Bowen wireline entry lubricator to the Bowen stub shown in FIG. 1 as 301 which would be fitted with a grease seal system (not shown) in a manner well known to those in the industry. The lubricator that permits the introduction of the wireline tools into the well string can be assembled off line and transported to the rig floor for connection to the top entry sub. Oftentimes primer cord, used for exploding inside and dislodging stuck pipe from the shock and vibration of the explosion, must be inserted into the well bore on the wireline. This and other types of explosive or dangerous tools can be safely introduced into the well string without having to expose the workers on the rig floor to the risk of premature detonation, outside of a containment tubular member.

Figure 8:
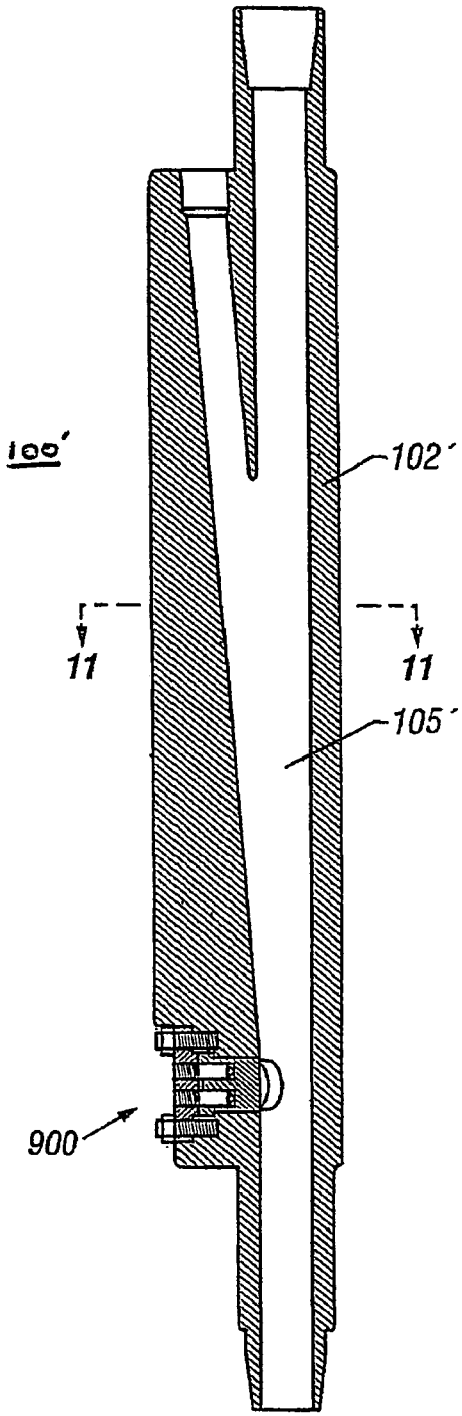
FIG. 8 is a cross sectional view of an alternative embodiment of the tool of this invention.

FIG. 8 discloses an alternative embodiment of the tool 100' of the present invention. The main body 102' is formed from an integral steel tubular blank to provide the pin and box connections described in the same manner as those described in connection with FIG. 1 above. The wireline tools and wireline are introduced into the body in the same manner as those described in connection with FIG. 1. Once the tools are below the wear shoulder device shown generally at 900 in FIG. 8, the shoulder 900 is adjusted and moved into a centralizing position of the well bore to hold the wireline off the interior surface 105' of the tool 102' to minimize the cutting of the interior surface of the tool from the manipulation of the wireline.

Figure 9:
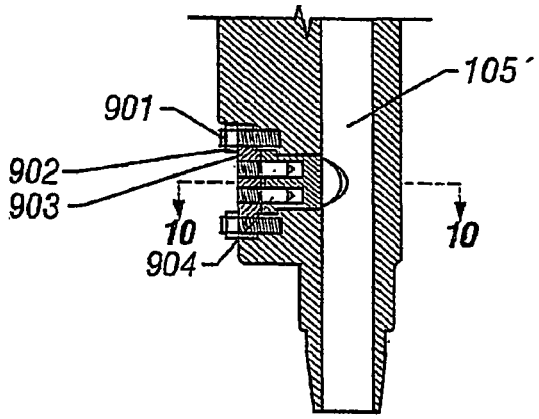
FIG. 9 is a side cross sectional view of the alternative embodiment of FIG. 8 showing the wear shoulder engagement mechanism in greater detail.
Figure 10:
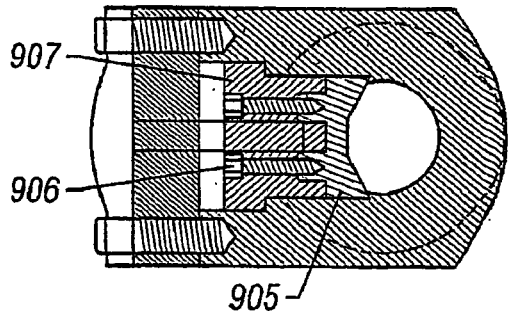
FIG. 10 is a top cross sectional view of the alternative embodiment of FIG. 8 showing a view of the wear shoulder through the line 10—10 of FIG. 9.

The wear shoulder support body and pad mechanism are more fully disclosed in FIGS. 9 and 10, which is enlarged side and top cross sectional view of the device 900 respectively. The support body 903 is affixed to the exterior surface of the tool 102' by setting bolts 901 and nuts 902 in a manner well known to those in this art. The wear shoulder pad 905 carried by body 907 which provides removable attachment of the wear shoulder 905 to the body, by mounting screws 906, is moved into and out of engagement with the wireline in the bore 105' by one or more cap head screws show at 904.

The wear pad 905 can be readily replaced in the field by removing the support body 903 from the tool 102' and removing the screws 906 which hold the pad 905 to the moveable body 907.

Figure 3:
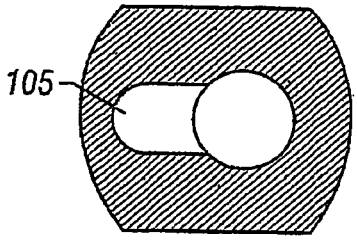
FIG. 3 is a cross sectional plan view of the tool through the line 3—3.
Figure 4:
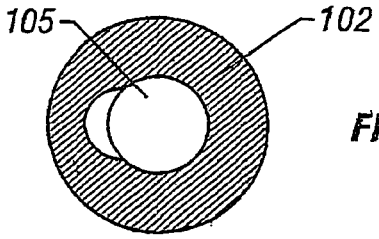
FIG. 4 is a cross-sectional plan view of the tool through the line 4—4.
Figure 11:
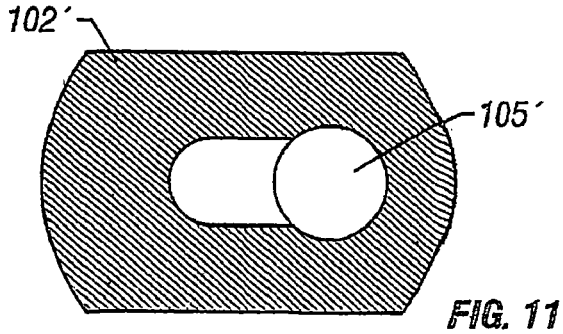
FIG. 11 is a top cross sectional view of the alternative embodiment of FIG. 8 through the line 11—11.

FIG. 11 is a top cross sectional view of the tool 102' through the line 11—11 in FIG. 8 which shows that this tool has the similar cross sectional passage as that shown in FIG. 3 above. The tool 102' is formed from an integral piece of tubular steel and does not require the use of a bottom saver sub, like the one shown in FIG. 1 above, but in all other respects would function in the same manner as the tool described in FIG. 1.

As can be readily appreciated from the review of the alternative embodiment shown in FIG. 8, the lower saver sub 201 of FIG. 1 is not attached to this form.

Figure 12:
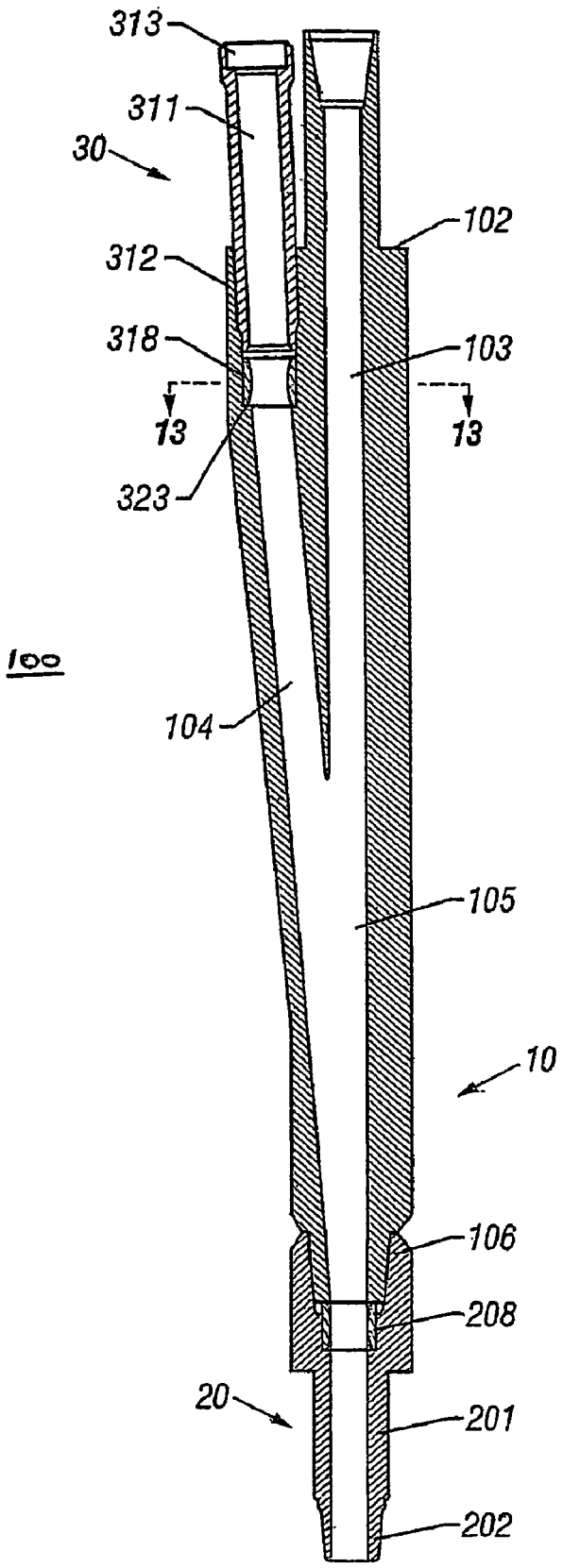
FIG. 12 is a side cross sectional view of another embodiment of the tool of this invention.

FIG. 12 is another embodiment of the tool 100 of the present invention. The primary difference between the embodiment shown in FIG. 1 and the embodiment shown in FIG. 12 is the addition of a wear bushing 318 adjacent the proximal terminus of the Bowen fitted lubricator joint 30, which is threaded into the body 10 with threads 312. The wear bushing 318 fabricated from a material that resists cutting by the passage of the wireline past it, for example, D2 tool steel, is stopped from rotation by key 319 (see FIG. 13) in key seat formed on the inner surface of the passage 104 in a manner exactly like that described above for the lower key and key seat of FIG. 1.

Figure 13:
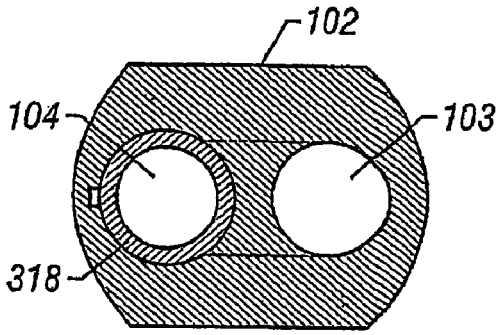
FIG. 13 is a top cross sectional view of the embodiment of FIG. 12 disclosing the upper wear bushing connection through the line 13—13 of said FIG. 12.

FIG. 13 is a top cross sectional view of the tool shown in FIG. 12 through the line 13—13. As can be readily appreciated, the wireline entry port with the wear bushing 318 inserted provides a bore 104 substantially equivalent to the central bore of the tool 103. Providing this wireline tool entry port to the drill string permits full sized downhole tools to be inserted in the drill string without disconnecting the drill string below the sub thereby eliminating unnecessary rig idle time in deep water projects, while providing a tool which supports as much tensile loading as the drill pipe to which it is attached.

The high tensile loading top entry sub shown in FIG. 12 provides two wear bushings or rings 318 and 208 to hold the wireline or coiled tubing off the interior wall of the sub while still allowing the introduction of wireline tools and coiled tubing tools through the Bowen fitting while the drill string is suspended from the box connection on the tool. The internal wear surfaces provided by the one or more bushings, along with the axial alignment of the tool over the longitudinal axis of the drill string which prevents the introduction of bending moments which can unduly stress the tubular connections either above or below the tool, provides the benefits of the prior art side entry sub with the benefits of the prior art top entry sub.

Since the apparatus of the present invention provides an axially aligned tool which is designed to be stronger than the weakest drill pipe connection in the entire drill string, which also permits wireline tools to be inserted in the well bore without disconnecting the drill string below the top entry sub to connect the tool after the wireline has been fed through the entry port on the top of the tool, this tool provides an improvement over all known tools currently used in the oil drilling industry, particularly for deep water projects. The tool provides an insert that can be readily rotated through a number of positions to allow long wear before needing replacement. This inner wear bushing (208, 905, 318) by holding the line off the interior surface of the tool permits the tool to have a long and trouble free service life.

The foregoing embodiments are presented by way of example only; the scope of the present invention is to be limited only by the following claims.

The invention claimed is:

1. An apparatus for accommodating the insertion of tools on wirelines and coiled tubing without disconnecting the apparatus from a drill string, the apparatus comprising:

an elongated tubular member having an upper end portion, a lower end portion, an inner peripheral surface defining a longitudinal passage, and a wireline passage, wherein the upper end portion has an upper threaded end and a wireline entry connection, the lower end portion has a lower threaded end, the longitudinal passage is between the upper threaded end and the lower threaded end, the upper and lower threaded ends and the longitudinal passage are in axial alignment for connection to the drill string, the wireline passage extending from the wireline entry connection and intersecting the longitudinal passage permitting entry of a wireline into the longitudinal passage of the tubular member; and a wear bushing carried on the inner peripheral surface of the tubular member, the wear bushing holding the wireline away from the adjacent interior surface of the longitudinal passage of the tubular member.

2. The apparatus of claim 1, wherein the wear bushing is slotted to allow moveable engagement with the inner peripheral surface of the tubular member wherein the wear bushing is rotated when worn at a particular position to present an unworn position.

3. The apparatus of claim 1, wherein the elongated tubular member is connected at the threaded lower end to a saver sub, the saver sub having an interior profile to position the wear bushing.

4. The apparatus of claim 1, further comprising a second wear bushing carried on a second inner peripheral surface of the wireline entry connection, wherein the second wear bushing holds the wireline away from the adjacent interior surface of the wireline passage.

5. An apparatus for the introduction of tools into a well bore comprising:

an elongated tubular member having an upper portion, a lower portion, an upper threaded connection, a wireline connection, a lower threaded connection, a first interior surface defining a longitudinal passage therethrough and a second interior surface defining a wireline passage, wherein the upper threaded connection is on the upper portion of the tubular member at a first end of the longitudinal passage for connection to a drill string, the wireline connection is on the upper portion at a first end of the wireline passage for connection to an entry lubricator, the lower threaded connection is on a lower portion of the tubular member at a lower end of the longitudinal passage for direct connection to a drill string, the upper threaded connection and the lower threaded connection are in axial alignment along the longitudinal axis of the longitudinal passage, and the wireline passage intersects the longitudinal passage such that the elongate tubular member permits the introduction of tools into the longitudinal passage from the entry lubricator; and an adjustable support for radial movement of a hard faced shoulder into the longitudinal passage below the intersection of the of the longitudinal and wireline passages, wherein in use the hard faced shoulder holds the wireline away from the interior surface of the longitudinal passage of the tubular member.

6. The apparatus of either claim 1 or claim 5 further comprising an angle of separation between the longitudinal axes of the longitudinal passage and the wireline passage of at most 4.0°.

7. An apparatus for accommodating the insertion of tools on wirelines and coiled tubing without disconnecting the apparatus from a drill string, the apparatus comprising:

an elongated tubular member having an upper end portion, a lower end portion, an inner peripheral surface defining a longitudinal passage, and a wireline passage, wherein the upper end portion has an upper threaded end and a wireline entry connection, the lower end portion has a lower threaded end, the longitudinal passage is between the tupper threaded end and the lower threaded end, the upper and lower end threaded ends and the longitudinal passage are in axial alignment for connection to the drill string, the wireline passage extending from the wireline entry connection and intersecting the longitudinal passage permitting entry of a wireline into the longitudinal passage of the tubular member; and an angle of separation between the longitudinal axes of the longitudinal passage and the wireline passage of at most 4.0°.

8. The apparatus of claim 7, further comprising a wear bushing carried on the inner peripheral surface of the tubular member, the wear bushing holding the wireline away from the adjacent interior surface of the longitudinal passage of the tubular member.

9. A method of wireline operation on a drilling rig comprising:

connecting the apparatus selected from the group from any one of claims 1–8 to drill string;

inserting a wireline and associated tool into the top of the apparatus;

applying torque on the drill string; and, manipulating the wireline while reciprocating the drill string.

10. A method of coiled tubing operation on a drilling rig comprising:

connecting the apparatus selected from the group consisting any one of claims 1–8 to the drill string;

inserting coiled tubing and tools into the top of the apparatus;

applying torque on the drill string; and, manipulating the coiled tubing and tools while maintaining torque on the drill string.

11. An apparatus to allow the insertion of tools disposed upon a conduit into a drill string, the apparatus comprising:

an elongated body, said elongated body having an upper end, a lower end, and an outer surface;

said upper end including an upper threaded drill pipe connection and a conduit entry port;

said lower end including a lower threaded drill pipe connection;

said elongated body including a longitudinal passage extending from said upper threaded drill pipe connection to said lower threaded drill pipe connection, wherein said longitudinal passage, said upper threaded pipe connection, and said lower threaded pipe connection are axially aligned;

said longitudinal passage defining a first peripheral surface;

said conduit entry port defining an entry passage, wherein said entry passage intersects said longitudinal passage and defines a second peripheral surface;

an first offset device configured to direct the conduit away from said first peripheral surface as the conduit passes therethrough; and a second offset device configured to direct the conduit away from said second peripheral surface as the conduit passes therethrough.

12. The apparatus of claim 11 wherein the conduit is a wireline.

13. The apparatus of claim 11 wherein the conduit is coiled tubing.

14. The apparatus of claim 11 wherein said first and said second offset devices are sleeves, said sleeves having a hardness greater than that of said first and said second peripheral surfaces.

15. The apparatus of claim 14 wherein said sleeves are constructed of D2 tool steel.

16. The apparatus of claim 14 wherein said sleeves are constructed with an indexing feature to allow rotation thereof with respect to said first and said second peripheral surfaces.

17. The apparatus of claim 16 wherein said indexing feature is a polygonal outer profile.

18. The apparatus of claim 16 wherein said indexing feature includes a plurality of longitudinal grooves.

19. The apparatus of claim 11 wherein said first offset device is a wear pad, said wear pad being configured to be engaged into and out of said longitudinal passage from said outer surface of said elongated body.

20. An apparatus to allow the insertion of tools disposed upon a conduit into a drill string, the apparatus comprising:

an elongated body, said elongated body having an upper end, a lower end, and an outer surface;

said upper end including an upper threaded drill pipe connection and a conduit entry port;

said lower end including a lower threaded drill pipe connection;

said elongated body including a longitudinal passage extending from said upper threaded drill pipe connection to said lower threaded drill pipe connection, wherein said longitudinal passage, said upper threaded pipe connection, and said lower threaded pipe connection are axially aligned;

said longitudinal passage defining a first peripheral surface;

said conduit entry port defining an entry passage, wherein said entry passage intersects said longitudinal passage and defines a second peripheral surface;

a wear pad configured to direct the conduit away from said first peripheral surface as the conduit passes therethrough; and said wear pad configured to be engaged and retracted into and out of said longitudinal passage from said outer surface of said elongated body.

21. The apparatus of claim 20 further comprising a second wear pad configured to direct the conduit away from said second peripheral surface as the conduit passes therethrough.

* * * * *